US007651208B2

(12) United States Patent
Matsumoto

(10) Patent No.: US 7,651,208 B2
(45) Date of Patent: Jan. 26, 2010

(54) LIQUID CONTAINER

(75) Inventor: Hitoshi Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 553 days.

(21) Appl. No.: 11/465,224

(22) Filed: Aug. 17, 2006

(65) Prior Publication Data

US 2007/0040874 A1 Feb. 22, 2007

(30) Foreign Application Priority Data

| | | |
|---|---|---|
| Aug. 17, 2005 | (JP) | 2005-236929 |
| Aug. 17, 2005 | (JP) | 2005-236930 |
| Jul. 20, 2006 | (JP) | 2006-198547 |
| Jul. 20, 2006 | (JP) | 2006-198548 |

(51) Int. Cl.
*B41J 2/175* (2006.01)

(52) U.S. Cl. ..... 347/86; 347/85

(58) Field of Classification Search ..... 347/19, 347/49, 86

See application file for complete search history.

(56) References Cited

U.S. PATENT DOCUMENTS

| | | | | |
|---|---|---|---|---|
| 5,856,840 | A * | 1/1999 | Barinaga et al. | 347/86 |
| 6,450,631 | B1 * | 9/2002 | Hayashi et al. | 347/86 |
| 6,832,830 | B2 * | 12/2004 | Seino et al. | 347/86 |
| 6,834,945 | B2 * | 12/2004 | Ishizawa et al. | 347/86 |

FOREIGN PATENT DOCUMENTS

| | | | |
|---|---|---|---|
| EP | 1 164 025 | A1 | 12/2001 |
| EP | 1 346 834 | A2 | 9/2003 |
| JP | 2002-019135 | A | 1/2002 |

OTHER PUBLICATIONS

International Search Report for int'l patent appln. No. PCT/JP2006/316538 (Nov. 23, 2006).

Written Opinion of the International Searching Authority for int'l patent appln. No. PCT/JP2006/316538 (Nov. 23, 2006).

* cited by examiner

*Primary Examiner*—Anh T. N. Vo

(74) *Attorney, Agent, or Firm*—Stroock & Stroock & Lavan LLP

(57) ABSTRACT

In an ink cartridge (liquid container) 1 of the invention, an ink delivery port 17 that connects an ink supply needle 15 of a cartridge holder 110 to an ink containing chamber 7 is disposed at an substantially central position in a shorter side direction of a container front surface 3*a*. Two positioning portions 13 and 14 that fit to positioning pins 11 provided at two places in the cartridge holder 110 so as to position a container main body 3, a pressurized air introduction portion 21 that connects a pressurized air supply path 19 of the cartridge holder 110 to a pressure chamber 5, and a data storage unit 25 that is connected to a connection terminal 23 of the cartridge holder 110 are disposed toward one side in a shorter side direction of the container front surface 3*a* with respect to the ink delivery port 17.

15 Claims, 7 Drawing Sheets

LIQUID CONTAINER

BACKGROUND OF THE INVENTION

1. Technical Field of the Invention

The present invention relates to a liquid container that contains a liquid to be supplied to a liquid jetting apparatus therein.

2. Description of the Related Art

As a liquid container that contains a liquid to be used in a liquid jetting apparatus, for example, an ink cartridge that is used in an ink jet printer can be exemplified. The ink cartridge for an ink jet printer has an ink containing chamber that is provided in a container main body and contains ink to be supplied to a printing head. Upon use, the ink cartridge is detachably fitted into and mounted on a cartridge mounting portion located at a predetermined position. Then, ink contained in the ink containing chamber is supplied to the printing head that is driven according to printing data to be transmitted from a host computer, and then is jetted to a target position on a subject to be printed, such as a paper or the like, by nozzles provided in the printing head.

In general, the ink jet printer has a carriage, on which the printing head ejecting ink droplets is mounted and which reciprocates in a direction perpendicular to a feed direction of the subject to be printed. Further, as a method of supplying ink from the ink cartridge to the printing head, a method of mounting the ink cartridge on the cartridge mounting portion provided in the carriage and supplying ink from the ink cartridge reciprocating along with the printing head to the printing head (a so-called on-carriage type) is used. Further, as another method, a method of mounting the ink cartridge on the cartridge mounting portion provided at a place other than the carriage of the ink jet printer and supplying ink from the ink cartridge to the printing head through an ink flow passage formed of a flexible tube (a so-called off-carriage type) is used.

As the ink cartridges that are mounted on the off-carriage type ink jet printers, various configurations including the configuration disclosed in JP-A-2002-19135 have been suggested.

An ink cartridge 201 shown in FIG. 11 is one disclosed in JP-A-2002-19135. In the ink cartridge 201, an ink containing chamber 209 whose volume is reducible by a pressure due to pressurized air to be supplied to a pressure chamber 207 in a container main body 205 is formed in the container main body 205 that is mounted on a cartridge mounting portion 203 of an ink jet printer. An ink liquid to be used in the ink jet printer is contained in the ink containing chamber 209. Two positioning portions 213 that fit to positioning units 211 provided at two places in the cartridge mounting portion 203 so as to position the container main body 205, an ink delivery port 217 that connects an ink supply path (an ink supply needle) 215 of the cartridge mounting portion 203 to the ink containing chamber 209, a pressurized air introduction portion 221 that connects a pressurized air supply path 219 of the cartridge mounting portion 203 to the pressure chamber 207, and a data storage unit 225 that is connected to a connection terminal 223 of the cartridge mounting portion 203 are provided at one surface (front end surface) of the container main body 205

The data storage unit 225 is a memory device that readably/writably stores various kinds of data, such as the kind of the ink cartridge 201 or consumption history of ink, from a control unit of the ink jet printer. As for the data storage unit 225, accurate positioning is needed such that an inconsistency, such as a defective operation due to contact failures of contacts to the connection terminal 223 of the cartridge mounting portion 203, is not caused.

Accordingly, in the ink cartridge 201, the positioning portions 213 are disposed immediately inside the pressurized air introduction portion 221 and the data storage unit 225 disposed at both ends of one surface of the cartridge main body 205 so as to be close to them, respectively.

The ink containing chamber of the ink cartridge desirably has a large ink containing capacity. However, as shown in FIGS. 11 and 12, in the structure in which all connection mechanisms disposed in the vicinity of the ink delivery port, such as the pressurized air introduction portion 221, the two positioning portions 213, the ink delivery port 217, the data storage unit 225, and so on, are substantially disposed in a line, the connection mechanisms occupy the front surface of the ink cartridge, and thus the external shape of the ink cartridge is made large with respect to the ink capacity so much. Further, in the cartridge mounting portion, the parts corresponding to the connection mechanisms are provided, and thus the ink cartridge is likely to be large in size.

In the configuration shown in FIG. 11, the interval P1 between the two positioning portions 213 is drastically made narrow compared with the width W1 of the container main body 205. Accordingly, when a torsional load indicated by arrows A and B in FIG. 12 is applied, displacement or deformation at both widthwise ends of the container main body 205 is insufficiently suppressed. Then, positioning accuracy of the data storage unit 225 may be degraded due to the displacement or deformation at both widthwise ends of the container main body 205, and the defective operation of the data storage unit 225 may be caused due to the contact failures of the contacts.

Displacement or deformation at both widthwise ends of the container main body may be caused due to a pressure by pressurized air to be supplied to the pressure chamber. In this case, positioning accuracy to the cartridge mounting portion may also be degraded.

SUMMARY OF THE INVENTION

A first object of the invention is to provide a liquid container, having a liquid delivery portion and connection mechanisms disposed on its front surface side, which can secure an ink capacity and reduce the size of an external shape.

A second object of the invention is to provide a liquid container that, even though a torsional load or a pressure of a pressure chamber is applied to a container main body, can suppress displacement or deformation with firm fixing by two positioning portions so as to keep accurate positioning states, and can suppress displacement or deformation of a container due to the displacement or deformation of the container main body so as to keep stable connection states by accurate positioning.

In order to solve at least one of the above problems, according to a first aspect of the invention, a liquid container comprising:

a container main body mountable on a container mounting portion of an apparatus using the liquid container;

a pressure chamber which is formed in the container main body and to which a pressurized fluid is supplied;

a liquid containing chamber which is formed in the container main body, a volume of the liquid container chamber being reducible by a pressure due to the pressurized fluid to be supplied to the pressure chamber;

two positioning portions, adapted to fit to positioning units provided at two places in the container mounting portion so as to position the container main body;

a liquid delivery portion, adapted to connect a liquid supply path of the container mounting portion to the liquid containing chamber;

a pressurized fluid introduction portion, adapted to connect a pressurized fluid supply path of the container mounting portion to the pressure chamber; and a data storage unit, adapted to connect to a connection terminal of the container mounting portion, wherein each of the two positioning portions, the pressurized fluid introduction portion, and the data storage unit is disposed toward one side in a direction of a shorter side of one surface of the container main body with respect to the container delivery portion.

According to the liquid container having the above configuration, the inside of the container main body in the shorter side direction of the one surface (a container thicknesswise direction) on a side, on which connection mechanisms, such as the two positioning portions, the pressurized fluid introduction portion, and the data storage unit, are not disposed can be used as the liquid containing chamber or the pressure chamber. Accordingly, the external shape of the liquid container relative to the internal volume can be reduced in size. In addition, since the individual connection mechanisms provided in the container mounting portion are disposed toward one side in the container thicknesswise direction, the configuration of the container mounting portion can be reduced in size in a thicknesswise direction of the liquid container, and thus the liquid container and the container mounting portion can be reduced in size.

In the liquid container according to the first aspect of the invention, an erroneous insertion prevention unit that is adapted to be fitted into an erroneous insertion prevention mechanism of the container mounting portion may be disposed toward the one side in the shorter side direction of the one surface of the container main body with respect to the liquid delivery portion.

According to the liquid container having the above configuration, when the erroneous insertion prevention unit that enables mounting of only the liquid container suitable for the container mounting portion is provided, the erroneous inserting prevention unit is disposed toward the one side in the shorter side direction of the one surface of the container main body, on which the connection mechanisms, such as the positioning portions and so on, are disposed. Therefore, the pressure is prevented from being applied to the internal volume of the liquid container.

In the liquid container according to the first aspect of the invention, a locking portion that is provided at another surface perpendicular to the one surface of the container main body and regulates separation of the container main body from the container mounting portion by fitting of a locking piece provided in the container mounting portion may be disposed on the substantially same plane as the two positioning portions.

According to the liquid container having the above configuration, when the container main body is mounted on the container mounting portion, the locking portion of the container main body is accurately positioned with respect to the container mounting portion. Therefore, the locking piece provided in the container mounting portion can accurately anchor the locking portion of the container main body. As a result, separation of the container main body from the container mounting portion can be reliably prevented.

Since a force applied from the locking piece of the container mounting portion to the locking portion of the container main body is applied in the substantially same plane as the two positioning portions, surface deflection of the container main body with respect to the plane can be prevented. Therefore, deflection of the container main body in a surface direction of the connection terminal, which causes degradation of contact of the connection terminal of the data storage unit and the connection terminal of the container mounting portion, can be reliably prevented. As a result, electrical connection of the connection terminal of the data storage unit and the connection terminal of the container mounting portion can be improved.

In the liquid container according to the first aspect of the invention, the pressure chamber may be formed such that an opening portion of the container main body provided on another side opposite to the one side, on which the two positioning portions, the pressurized fluid introduction portion, and the data storage unit are disposed, is sealed by a film.

According to the liquid container having the above configuration, it is easy to provide the liquid containing chamber from the large opening portion, with no connection mechanisms, such as the positioning portions and so on, before the opening portion of the container main body is sealed by the film (to load ink packs). Further, since there is no case where, when the film is welded, the connection mechanisms obstruct the work, good assembling workability is obtained.

In the liquid container according to the first aspect of the invention, the two positioning portions may be disposed at both longitudinal edges of the one surface of the container main body, and the liquid delivery portion, the pressurized fluid introduction portion, and the data storage unit may be disposed between the two positioning portions.

According to the liquid container having the above configuration, the two positioning portions that position the container main body on the container mounting portion when the container main body is mounted on the container mounting portion of the apparatus are provided at both longitudinal edges of one surface of the container main body, that is, at positions having high rigidity close to a side wall of the container main body. For this reason, even though a torsional load is applied, displacement or deformation at both longitudinal ends of one surface of the container main body can be suppressed within fitting accuracy of the positioning portions and the positioning units of the container mounting portion. The displacement or deformation can be further suppressed by the liquid delivery portion, the pressurized fluid introduction portion, and the data storage unit provided between the two positioning portions. Therefore, displacement or deformation of the container main body can be suppressed through firm fixing by the two positioning portions. As a result, a stable connection state can be kept by accurate positioning states.

In the liquid container according to the first aspect of the invention, the erroneous insertion prevention unit that is fitted into the erroneous insertion prevention mechanism may be provided between the two positioning portions.

According to the liquid container having the above configuration, when the erroneous insertion prevention unit of the liquid container is fitted into the erroneous insertion prevention mechanism of the container mounting portion that enables mounting of only the liquid container suitable for the container mounting portion, since the erroneous insertion prevention unit is disposed between the two positioning portions, positioning to the erroneous insertion prevention mechanism is accurately performed. For this reason, there is no case where, when a suitable liquid container is mounted, the erroneous insertion prevention unit erroneously comes into contact with the erroneous insertion prevention mechanism before a mounting position.

In the liquid container according to the first aspect of the invention, the positioning units provided at two places in the container mounting portion may be columnar positioning pins. One of the two positioning portions may be a first fitting hole, having a circular sectional shape, into which the positioning pin is fitted closely, and the other positioning portion may be a second fitting hole, having an elliptical sectional shape, which restricts the positioning pin to move only in a direction along a longer side of the one surface of the container main body.

According to the liquid container having the above configuration, the first fitting hole, which is one of the two positioning portions, is formed in the circular sectional shape. The one of the columnar positioning pins, which is the positioning unit of the container mounting portion, is closely fitted into the first fitting hole, such that the position is uniformly regulated over in all directions in the section. Therefore, high positioning accuracy is shown. Further, the second fitting hole is formed in the elliptical sectional shape. Then, the other columnar positioning pin of the container mounting portion that is fitted into the second fitting hole moves in a major axis direction of the ellipse, and thus an error in length in a longer side direction of one surface of the container main body can be allowed. Therefore, with the error in length, mounting capability to the container mounting portion can be prevented from being damaged, and thus a work, such as replacement of the liquid container to the container mounting portion, can be easily performed.

In the liquid container according to the first aspect of the invention, the data storage unit may be disposed close to the first fitting hole.

According to the liquid container having the above configuration, the data storage unit that is disposed close to the first fitting hole showing high positioning accuracy compared with the second fitting hole can be accurately positioned. Therefore, there is no case where a contact failure to the connection terminal of the container mounting portion is caused by degradation of positioning accuracy.

In order to solve at least one of the above problems, according to a second aspect of the invention, a liquid container comprising:

a container main body mountable on a container mounting portion of an apparatus using the liquid container;

a pressure chamber which is formed in the container main body and to which a pressurized fluid is supplied;

a liquid containing chamber which is formed in the container main body, a volume of the liquid container chamber being reducible by a pressure due to the pressurized fluid to be supplied to the pressure chamber;

two positioning portions which is adapted to fit to positioning units provided at two places in the container mounting portion so as to position the container main body;

a liquid delivery portion which is adapted to connect a liquid supply path of the container mounting portion to the liquid containing chamber;

a pressurized fluid introduction portion which is adapted to connect a pressurized fluid supply path of the container mounting portion to the pressure chamber; and a data storage unit which is adapted to connect to a connection terminal of the container mounting portion, wherein the two positioning portions are disposed at both longitudinal edges of one surface of the container main body, and the liquid delivery portion, the pressurized fluid introduction portion, and the data storage unit are disposed between the two positioning portions.

According to the liquid container having the above configuration, the two positioning portions that position the container main body on the container mounting portion when the container main body is mounted on the container mounting portion of the apparatus are provided at both longitudinal edges of one surface of the container main body, that is, at positions having high rigidity close to a side wall of the container main body. For this reason, even though a torsional load is applied, displacement or deformation at both longitudinal ends of one surface of the container main body can be suppressed within fitting accuracy of the positioning portions and the positioning units of the container mounting portion. The displacement or deformation can be further suppressed by the liquid delivery portion, the pressurized fluid introduction portion, and the data storage unit provided between the two positioning portions. Therefore, displacement or deformation of the container main body can be suppressed through firm fixing by the two positioning portions. As a result, a stable connection state can be kept by accurate positioning states.

In the liquid container according to the second aspect of the invention, an erroneous insertion prevention unit that is adapted to be fitted into an erroneous insertion prevention mechanism of the container mounting portion may be provided between the two positioning portions.

According to the liquid container having the above configuration, when the erroneous insertion prevention unit of the liquid container is fitted into the erroneous insertion prevention mechanism of the container mounting portion that enables mounting of only the liquid container suitable for the container mounting portion, since the erroneous insertion prevention unit is disposed between the two positioning portions, positioning to the erroneous insertion prevention mechanism is accurately performed. For this reason, there is no case where, when a suitable liquid container is mounted, the erroneous insertion prevention unit erroneously comes into contact with the erroneous insertion prevention mechanism before a mounting position and mounting becomes impossible.

In the liquid container according to the second aspect of the invention, the positioning units provided at two places in the container mounting portion may be columnar positioning pins. One of the two positioning portions may be a first fitting hole, having a circular sectional shape, into which one of the positioning pins is fitted closely, and the other positioning portion may be a second fitting hole, having an elliptical sectional shape, which restricts the other positioning pin to move only in a direction along a longer side of the one surface of the container main body.

According to the liquid container having the above configuration, the first fitting hole, which is one of the two positioning portions, is formed in the circular sectional shape. The columnar positioning pin, which is the positioning unit of the container mounting portion, is closely fitted into the first fitting hole, such that the position is uniformly regulated over in all directions in the section. Therefore, high positioning accuracy is shown. Further, the second fitting hole is formed in the elliptical sectional shape. Then, the columnar positioning pin of the container mounting portion that is fitted into the second fitting hole moves in a major axis direction of the ellipse, and thus an error in length in a longer side direction of one surface of the container main body can be allowed. Therefore, with the error in length, mounting capability to the container mounting portion can be prevented from being damaged, and thus a work, such as replacement of the liquid container to the container mounting portion, can be easily performed.

In the liquid container according to the second aspect of the invention, the data storage unit may be disposed close to the first fitting hole.

According to the liquid container having the above configuration, the data storage unit that is disposed close to the first fitting hole showing high positioning accuracy compared with the second fitting hole can be accurately positioned. Therefore, there is no case where a contact failure to the connection terminal of the container mounting portion is caused by degradation of positioning accuracy.

In the liquid container according to the second aspect of the invention, the two positioning portions, the pressurized fluid introduction portion, and the data storage unit may be disposed toward one side in a direction of a shorter side of the one surface of the container main body with respect to the container delivery portion.

According to the liquid container having the above configuration, the inside of the container main body in the shorter side direction of the one surface (a container thicknesswise direction) on a side, on which connection mechanisms, such as the two positioning portions, the pressurized fluid introduction portion, and the data storage unit, are not disposed can be used as the liquid containing chamber or the pressure chamber. Accordingly, the external shape of the liquid container relative to the internal volume can be reduced in size. In addition, since the individual connection mechanisms provided in the container mounting portion are disposed toward one side in the container thicknesswise direction, the configuration of the container mounting portion can be reduced in size in a thicknesswise direction of the liquid container, and thus the liquid container and the container mounting portion can be reduced in size.

In the liquid container according to the second aspect of the invention, the erroneous insertion prevention unit that is adapted to be fitted into the erroneous insertion prevention mechanism of the container mounting portion may be disposed toward the one side in a direction of the shorter side of the one surface of the container main body with respect to the liquid delivery portion.

According to the liquid container having the above configuration, when the erroneous insertion prevention unit that enables mounting of only the liquid container suitable for the container mounting portion is provided, the erroneous inserting prevention unit is disposed toward the one side in the shorter side direction of the one surface of the container main body, on which the connection mechanisms, such as the positioning portions and so on, are disposed. Therefore, the pressure is prevented from being applied to the internal volume of the liquid container.

In the liquid container according to the second aspect of the invention, the pressure chamber may be formed such that an opening portion of the container main body provided on another side opposite to the one side, on which the two positioning portions, the pressurized fluid introduction portion, and the data storage unit are disposed, is sealed by a film.

According to the liquid container having the above configuration, it is easy to provide the liquid containing chamber from the large opening portion, with no connection mechanisms, such as the positioning portions and so on, before the opening portion of the container main body is sealed by the film (to load ink packs). Further, since there is no case where, when the film is welded, the connection mechanisms obstruct the work, good assembling workability is obtained.

In the liquid container according to the first aspect of the invention, the inside of the container main body in the container thicknesswise direction on a side, on which connection mechanisms, such as the two positioning portions, the pressurized fluid introduction portion, and the data storage unit, are not disposed, can be used as the liquid containing chamber or the pressure chamber. Accordingly, the external shape of the liquid container relative to the internal volume can be reduced in size. Therefore, an ink capacity to be contained in the liquid container can be secured, and the external shape thereof can be reduced in size.

Further, since the individual connection mechanisms provided in the container mounting portion are disposed toward one side in the thicknesswise direction, the configuration of the container mounting portion can be reduced in size in the thicknesswise direction of the liquid container, and thus the liquid container and the container mounting portion can be reduced in size.

In the liquid container according to the second aspect of the invention, the two positioning portions are provided at both longitudinal edges of one surface of the container main body, that is, at positions having high rigidity close to the side wall of the container main body. For this reason, even though the torsional load or the pressure of the pressure chamber is applied to the container main body, displacement or deformation at both longitudinal ends of one surface of the container main body can be suppressed through firm fixing by the two positioning portions, and thus accurate positioning states can be kept. The displacement or deformation can be further suppressed by the liquid delivery portion, the pressurized fluid introduction portion, and the data storage unit provided between the two positioning portions. As a result, a stable connection state can be kept by accurate positioning states.

DETAILED DESCRIPTION OF THE INVENTION

An embodiment of a liquid container according to the invention will now be described in detail with reference to the drawings.

Figure 1:
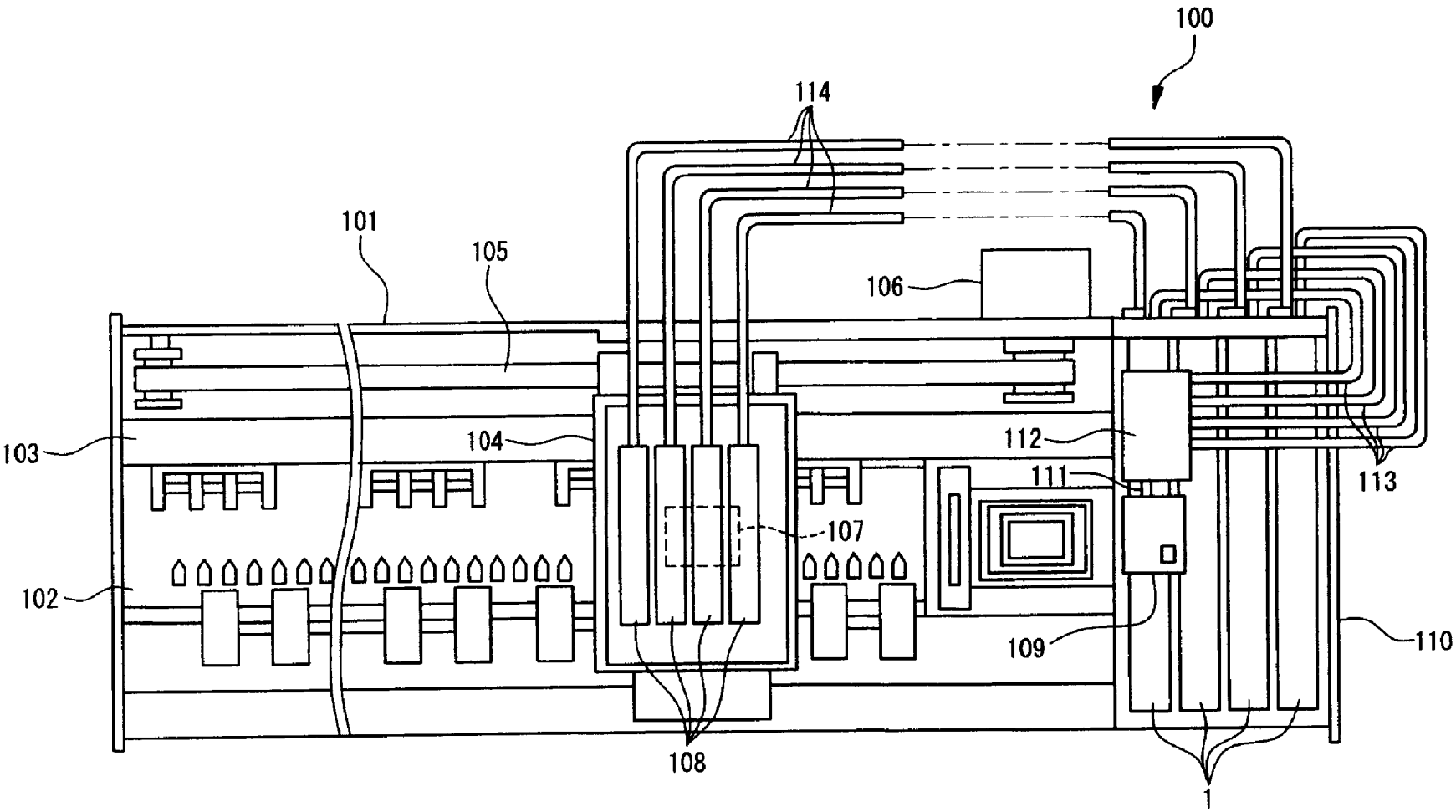
FIG. 1 is a plan view of an ink jet printer, on which an ink cartridge as a liquid container according to an embodiment of the invention is mounted.
Figure 2:
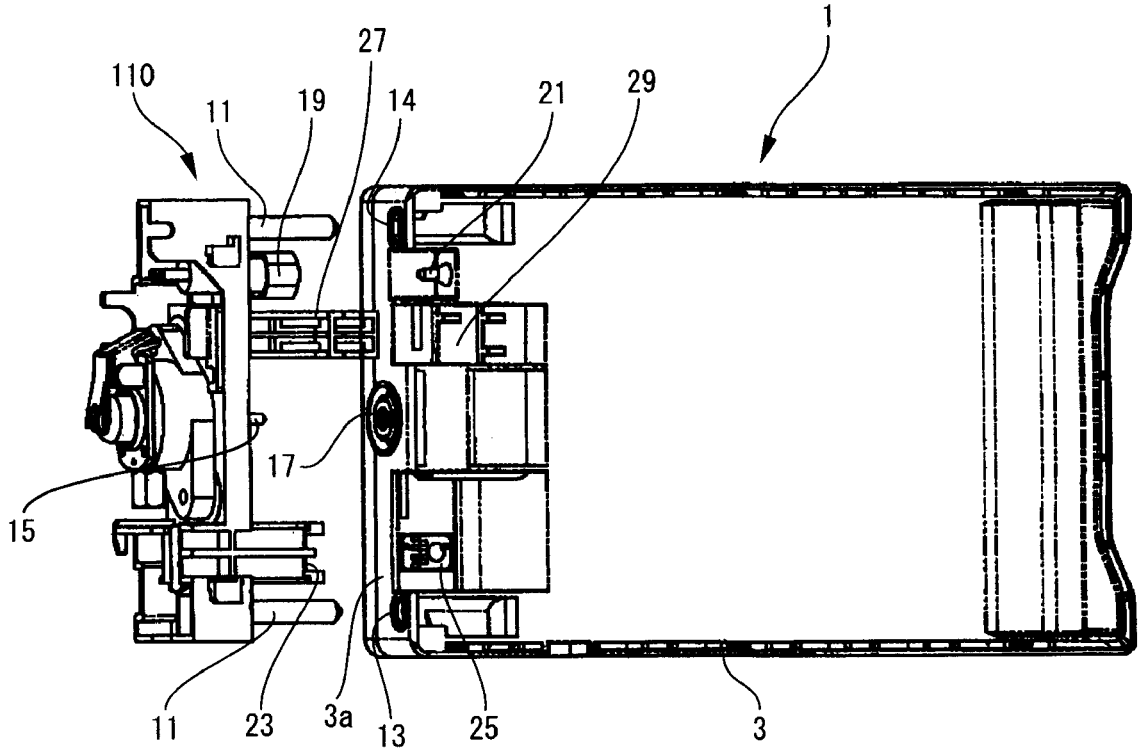
FIG. 2 is a perspective view of an ink cartridge and a cartridge mounting portion shown in FIG. 1.
Figure 3:
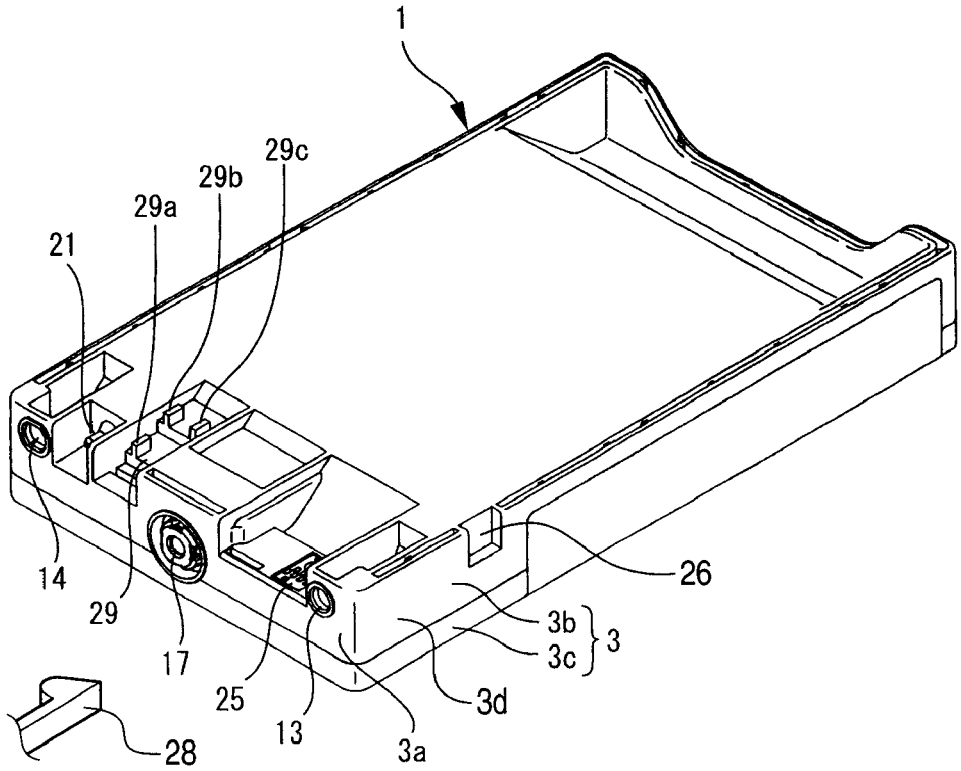
FIG. 3 is a perspective view of a single ink cartridge shown in FIG. 1.
Figure 4:
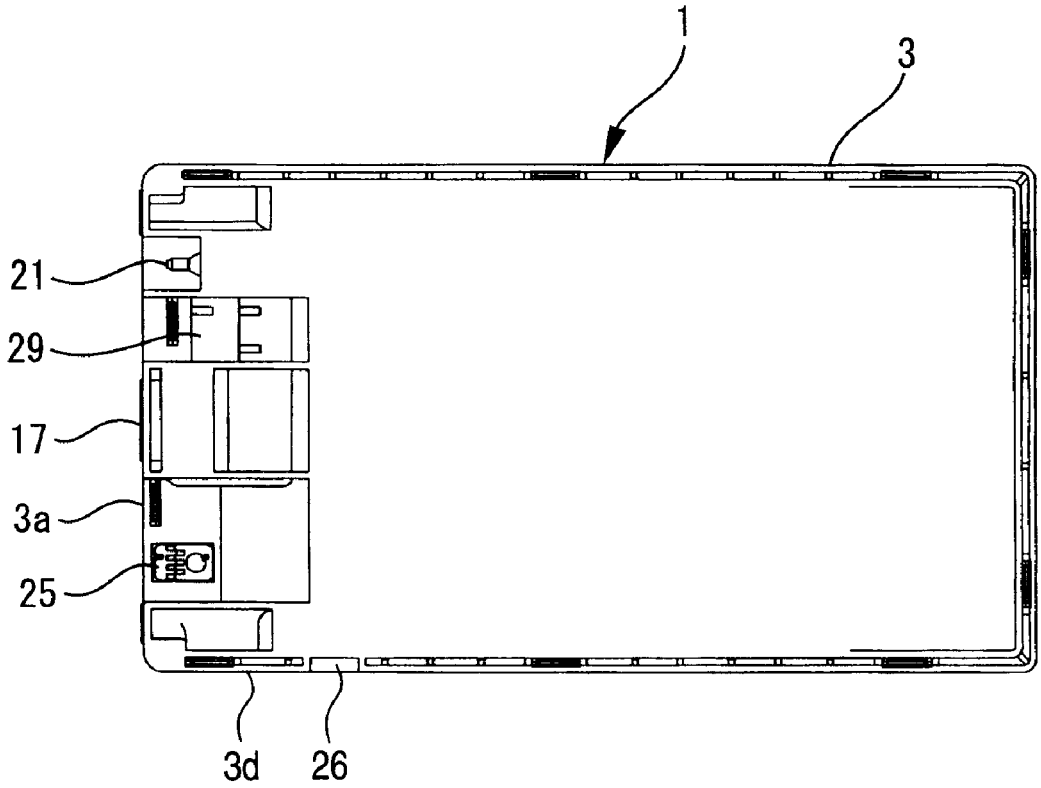
FIG. 4 is a left side view of an ink cartridge shown in FIG. 3.
Figure 5:
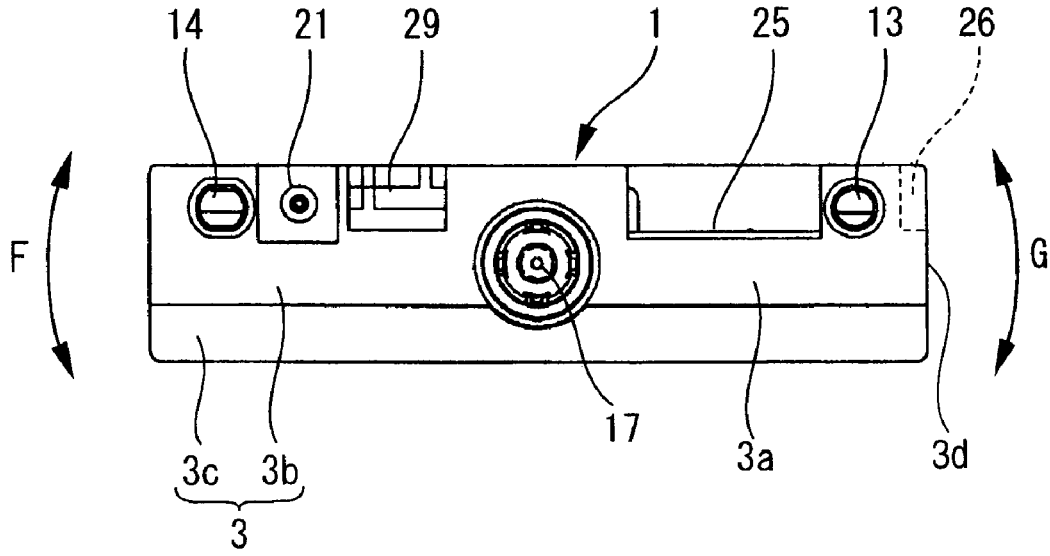
FIG. 5 is a front view of an ink cartridge shown in FIG. 3.
Figure 6:
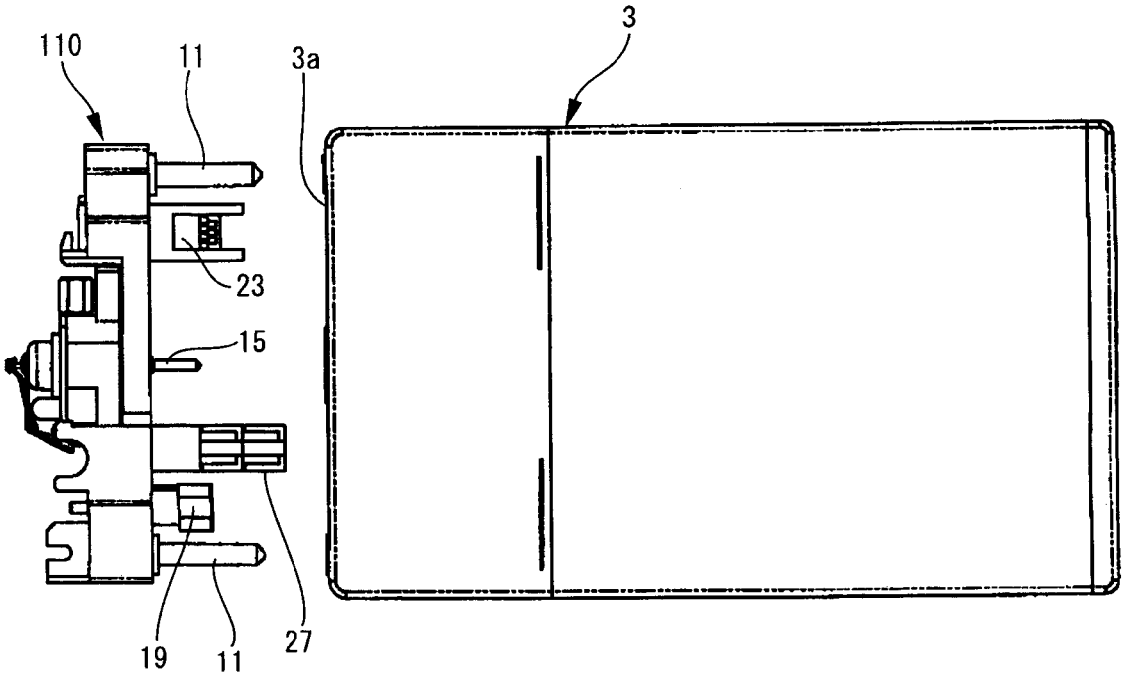
FIG. 6 is a diagram showing the positional relationship of a left side view of an ink cartridge shown in FIG. 3 and a cartridge mounting portion on which the ink cartridge is mounted.
Figure 7:
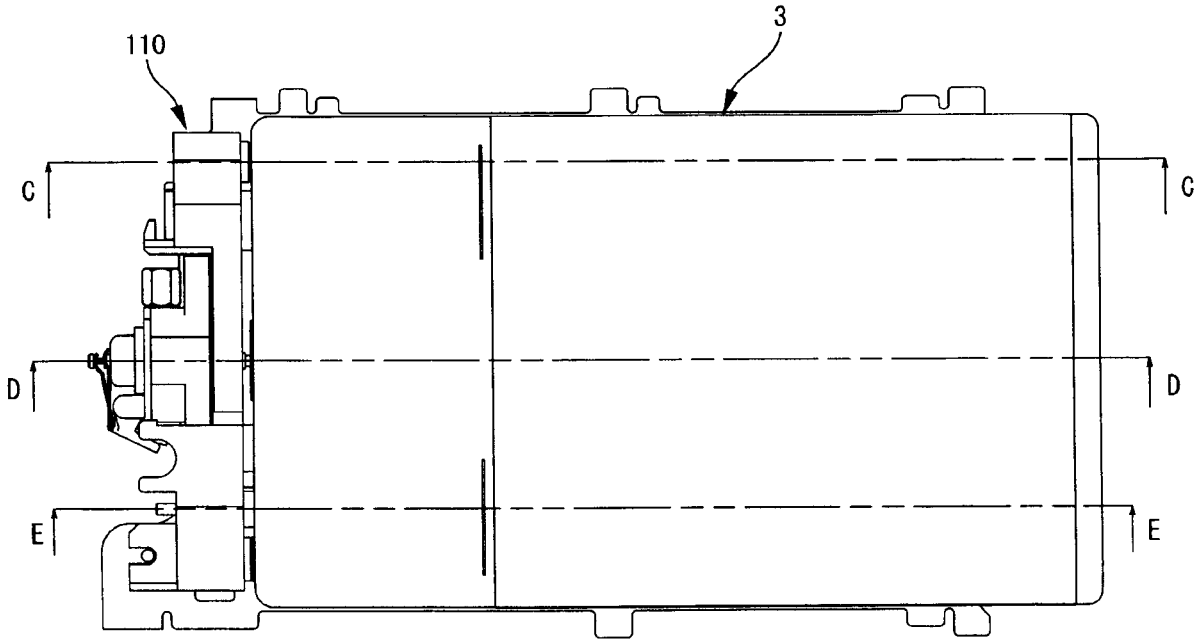
FIG. 7 is an explanatory view of a connection state of an ink cartridge and a cartridge mounting portion shown in FIG. 6.
Figure 8:
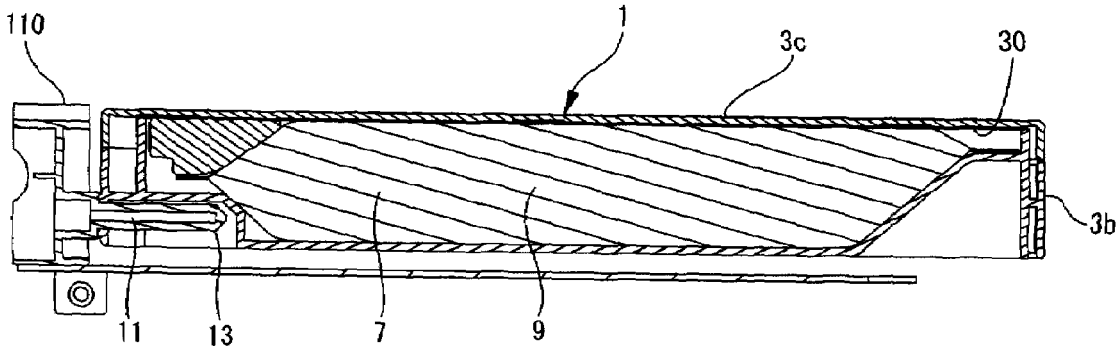
FIG. 8 is a cross-sectional view taken along the line VIII-VIII of FIG. 7.
Figure 9:
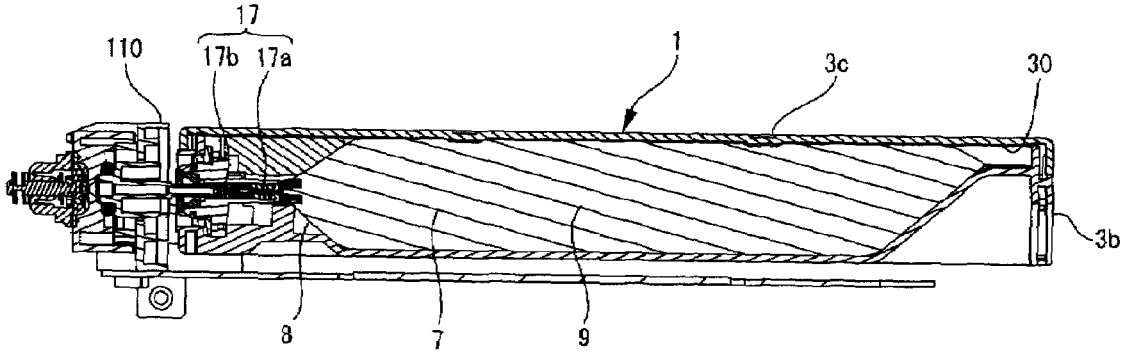
FIG. 9 is a cross-sectional view taken along the line IX-IX of FIG. 7.
Figure 10:
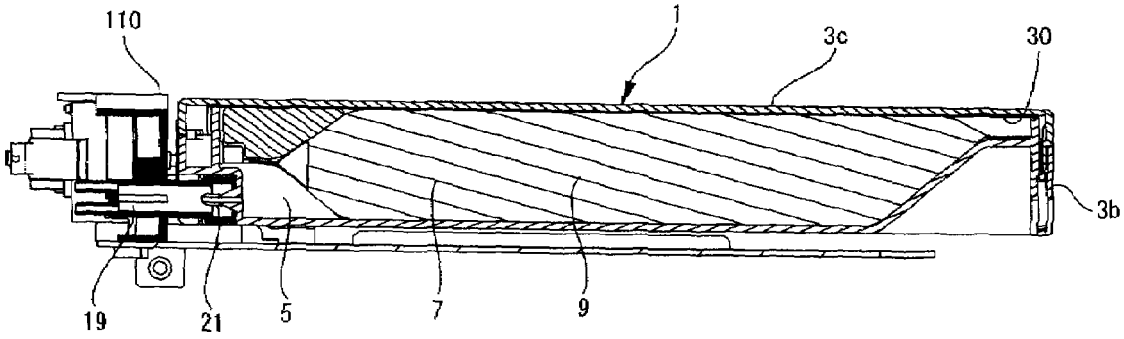
FIG. 10 is a cross-sectional view taken along the line X-X of FIG. 7.
Figure 11:
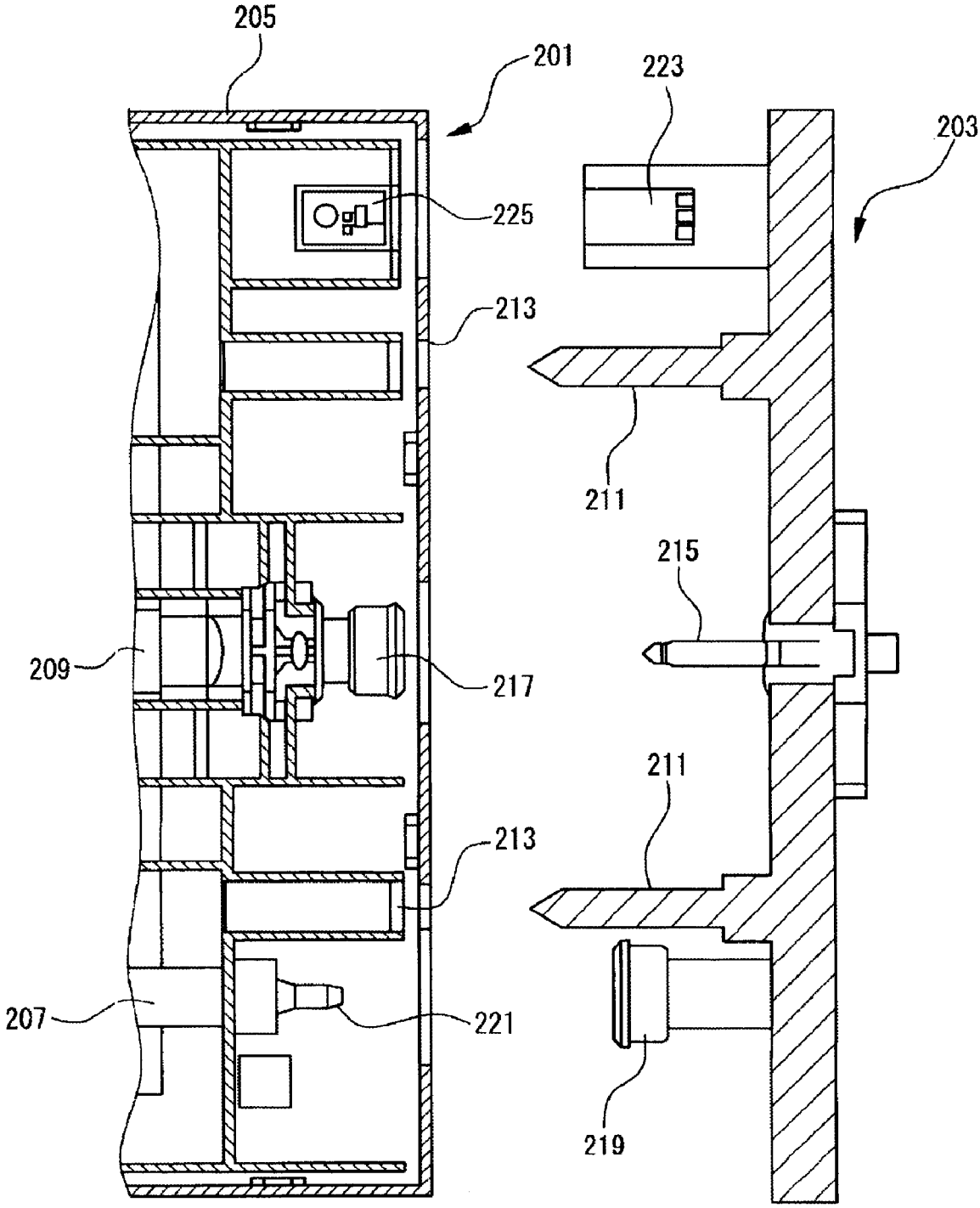
FIG. 11 (PRIOR ART)
FIG. 11 is a cross-sectional view of essential parts of an ink cartridge as a representative one of a known liquid container.
Figure 12:
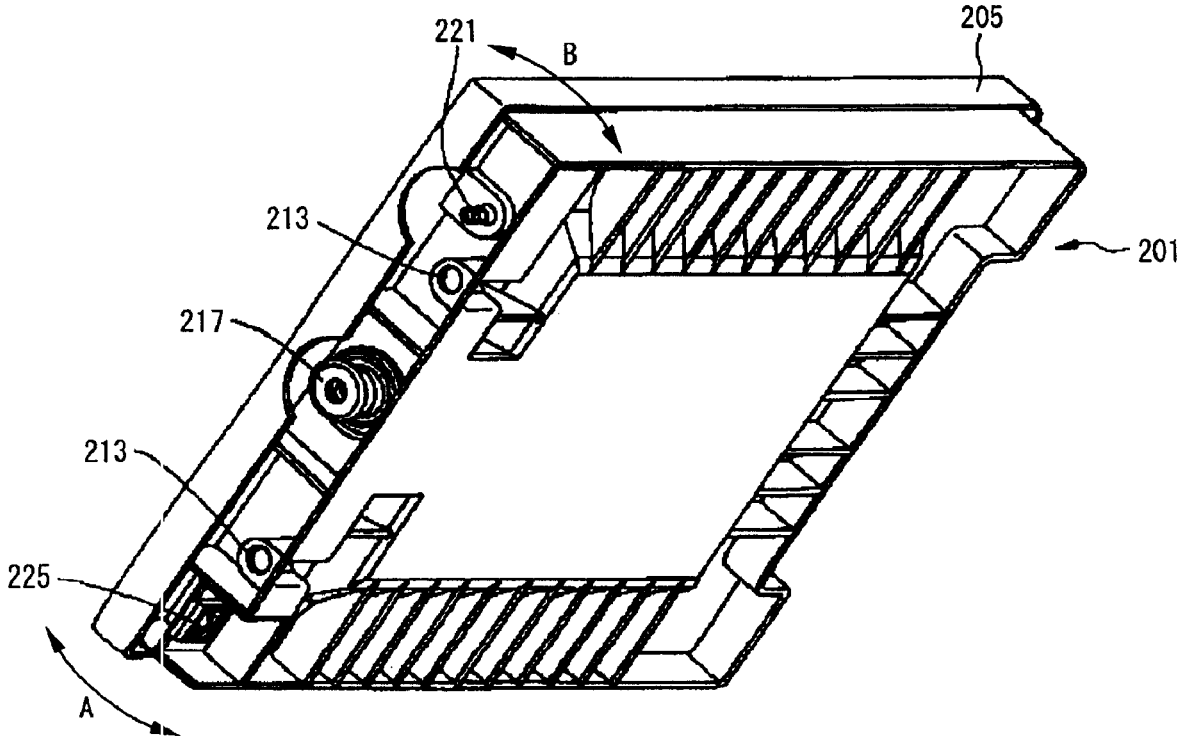
FIG. 12 (PRIOR ART)
FIG. 12 is an external perspective view of an ink cartridge shown in FIG. 11.

FIG. 1 is a plan view of an ink jet printer, on which an ink cartridge as a liquid container according to an embodiment of the invention is mounted. FIG. 2 is a perspective view of an ink cartridge and a cartridge mounting portion shown in FIG. 1. FIG. 3 is a perspective view of a single ink cartridge shown in FIG. 1. FIG. 4 is a left side view of an ink cartridge shown in FIG. 3. FIG. 5 is a front view of an ink cartridge shown in FIG. 3. FIG. 6 is a diagram showing the positional relationship of a left side view of an ink cartridge shown in FIG. 3 and a cartridge mounting portion on which the ink cartridge is mounted. FIG. 7 is an explanatory view of a connection state of an ink cartridge and a cartridge mounting portion shown in FIG. 6. FIG. 8 is a cross-sectional view taken along the line VIII-VIII of FIG. 7. FIG. 9 is a cross-sectional view taken along the line IX-IX of FIG. 7. FIG. 10 is a cross-sectional view taken along the line X-X of FIG. 7.

An ink jet printer 100, serving as a liquid jetting apparatus, shown in FIG. 1 has a printer main body case 101, a platen 102, a guide shaft 103, a carriage 104, a timing belt 105, a carriage motor 106, and a printing head 107 serving as a liquid jetting head. In addition, the ink jet printer 100 has valve units 108 and a pressure pump 109.

The printer main body case 101 is a box having an substantially rectangular parallelepiped. At a right end in FIG. 1, a cartridge holder 110 serving as a container mounting portion is provided. In the cartridge holder 110, ink cartridges 1 as a liquid container according to this embodiment are detachably provided. Four ink cartridges 1 are mounted corresponding to ink colors (black, yellow, magenta, and cyan).

The platen 102 is a member that is provided erect along a main scanning direction of the printing head 107 in the printer main body case 101 and supports a subject to be printed (not shown), such as a paper or the like, to be fed through a paper feed unit (not shown). Moreover, the subject to be printed is fed in a direction perpendicular to a direction in which the carriage 104 reciprocates.

The guide shaft 103 is formed in a rod shape and is provided erect along the main scanning direction parallel to the platen 102 in the printer main body case 101. The carriage 104 is movably inserted into the guide shaft 103 at a position facing the platen 102 so as to reciprocate.

The carriage 104 is connected to the carriage motor 106 through the timing belt 105. The carriage motor 106 is supported on the printer main body case 101. When the carriage motor 106 is driven, the carriage 104 is driven through the timing belt 105 and reciprocates along the guide shaft 103.

The printing head 107 has a plurality of nozzles that jet ink droplets toward the platen 102. The valve units 108 are mounted on the carriage 104 so as to supply ink temporarily contained therein to the printing head 107 in a state where a pressure is adjusted. Moreover, in this embodiment, four valve units 108 are provided corresponding to ink colors (black, yellow, magenta, and cyan).

The pressure pump 109 is connected to a pressure detector 112 through a connection tube 111, and the pressure detector 112 is connected to the individual ink cartridges 1 through individual air supply tubes 113. Further, the ink cartridges 1 and the valve units 108 are respectively connected to each other through individual ink supply tubes 114.

Next, the ink cartridge 1 as the liquid container according to the invention will be described with reference to FIGS. 2 to 10.

The ink cartridge 1 has a pressure chamber 5 shown in FIG. 10 and an ink containing chamber 7 shown in FIG. 9 that are divisionally formed in a cartridge main body 3 to be mounted on the cartridge holder 110 as the container mounting portion of the ink jet printer 100.

The ink containing chamber 7 has a pouch body 8 as an ink pack, for example, formed by overlapping flexible films and welding their peripheries. The volume of the ink containing chamber 7 is reducible by a pressure due to pressurized air to be supplied to the pressure chamber 5. An ink liquid 9 that the ink jet printer 100 consumes is contained in the ink containing chamber 7.

As types of the pouch body of the ink pack, a type in which two film members are adhered to each other along their peripheries, and a type in which a pair of film members are provided in a thicknesswise direction of the ink pack so as to form four side surfaces are known. In this embodiment, the pouch body 8 is the latter that is called a cassette-type ink pack. The cassette-type ink pack is suitable for increasing an ink containing capacity.

As shown in FIG. 3, the cartridge main body 3 is a closed box having an external shape of an substantially rectangular parallelepiped. The cartridge main body 3 is assembled in a butt structure of a main body main portion 3*b* and a cover portion 3*c* covering an opening portion of the main body main portion 3*b*. Further, as shown in FIGS. 8 to 10, inside the cover portion 3*c* covering the opening portion of the main body main portion 3*b*, a peripheral portion of the opening portion of the main body main portion 3*b* is welded and sealed by a film 30. Then, an inner space of the main body main portion 3*b* sealed by the film 30 forms the pressure chamber 5.

At a container front surface 3*a* of the main body main portion 3*b* as one surface of the cartridge main body 3, as shown in FIGS. 2 to 5, two positioning portions 13 and 14 that fit to columnar positioning pins 11 as positioning units provides at two places in the cartridge holder 110 so as to position the cartridge main body 3, an ink delivery port (a liquid delivery portion) 17 that connects an ink supply needle 15 provided as a liquid supply path in the cartridge holder 110, a pressurized air introduction portion (a pressurized fluid introduction portion) 21 that connects a pressurized air supply path (a pressurized fluid supply path) 19 of the cartridge holder 110 to the pressure chamber 5, and an erroneous insertion prevention unit 29 that is fitted into an erroneous insertion prevention mechanism 27 of the cartridge holder 110 are provided. The container front surface 3*a* is a surface that becomes a front end surface in an insertion direction when the ink cartridge 1 is inserted into and mounted on the cartridge holder 110.

In this embodiment, the two positioning portions 13 and 14, the pressurized air introduction portion 21, the data storage unit 25, and the erroneous insertion prevention unit 29, which are disposed at the container front surface 3*a*, are disposed toward one side in a shorter side direction of the container front surface 3*a* of the cartridge main body 3 with respect to the ink delivery port 17.

At a container side surface 3*d* of the main body main portion 3*b* that is another surface perpendicular to the container front surface 3*a* of the main body main portion 3*b*, as shown in FIGS. 3 to 5, a locking portion 26 that regulates separation of the container main body 3 from the container mounting portion 110 by fitting of a locking piece 28 provided in the container mounting portion 110 is provided.

In this embodiment, the locking portion 26 provided at the container side surface 3*d* is disposed on the substantially same plane as the two positioning portions 13 and 14 disposed at the container front surface 3*a*.

As shown in FIG. 5, one positioning portion 13 of the two positioning portions 13 and 14 that fit to the positioning pins 11 provided at the two places in the cartridge holder 110 is a first fitting hole having a circular sectional shape. The positioning pin 11 is closely fitted into the positioning portion 13. The other positioning portion 14 is a second fitting hole having an elliptical sectional shape, which restricts the positioning pin 11 to move only in a direction along a longer side of the container front surface 3*a* of the container main body 3.

In this embodiment, the two positioning portions 13 and 14 are disposed at both edges in a shorter side direction of the container front surface 3*a* of the cartridge main body 3, that is, in the vicinity of a small side surface of the cartridge main body 3 in a widthwise direction. These positions have relatively high rigidity in the cartridge main body 3. The ink delivery port 17, the pressurized air introduction portion 21, and the data storage unit 25, and the erroneous insertion prevention unit 29 are disposed between the two positioning portions 13 and 14.

As shown in FIG. 9, the ink delivery port 17 has a cylinder portion 17*a* that is connected airtight to one end of the pouch body 8 divided in the ink containing chamber 7, and an opening/closing valve 17*b* that opens/closes a flow passage along the cylinder portion 17*a*. As shown in FIG. 5, the ink delivery port 17 is disposed at an substantially central position in the widthwise direction of the container front surface 3*a* (in a longer side direction of the container front surface 3*a*) and at an substantially central position in a thicknesswise direction of the container front surface 3*a* (a shorter side direction of the container front surface 3*a*).

As shown in FIG. 9, in the ink delivery port 17, if the ink supply needle 15 of the cartridge holder 110 is inserted into the cylinder portion 17*a*, the opening/closing valve 17*b* opens the flow passage, and then an ink liquid 9 in the ink containing chamber 7 can flow in the ink supply needle 15.

The ink supply tubes 114 shown in FIG. 1 are connected to the ink supply needle 15, and thus the ink liquid supplied from the ink containing chamber 7 to the ink supply needle 15 is supplied to the printing head 107 through the ink supply tubes 114 and the valve units 108.

The pressurized air supply path 19, to which the air supply tubes 113 shown in FIG. 1 are connected, is a discharge port of pressurized air. As shown in FIG. 10, an substantially cylindrical pressurized air introduction portion 21 can be fitted airtight into the pressurized air supply path 19, and thus pressurized air is supplied to the pressure chamber 5 in the cartridge main body 3 through the connected pressurized air introduction portion 21.

The data storage unit 25 is an IC chip that is electrically connected to a control unit of the ink jet printer 100 by contact to a connection terminal 23 of the cartridge holder 110 and has a memory, in which data reading and writing are made. The data storage unit 25 is disposed at a position close to the positioning portion 13 as the first fitting hole having a circular sectional shape such that the connection terminal of the data storage unit 25 is positioned to the connection terminal 23 of the cartridge holder 110 with high accuracy.

As shown in FIG. 3, the erroneous insertion prevention unit 29 has a characteristic structure by a plurality of ribs 29*a*, 29*b*, 29*c*, . . . arranged in a cubic shape at a portion of a container wall according to kinds of the contained ink liquid, kinds of the ink jet printer, a mounting position of the ink cartridge, and so on. Accordingly, if grooves, into which the individual ribs 29*a*, 29*b*, 29*c*, . . . are inserted, are empty in the erroneous insertion prevention mechanism 27 of the cartridge holder 110, the cartridge main body 3 cannot be mounted due to inference of the ribs, and thus erroneous insertion is prevented.

In the above-described ink cartridge 1, the two positioning portions 13 and 14 that position the cartridge main body 3 on the cartridge holder 110 when the ink cartridge 1 is mounted on the cartridge holder 110 of the ink jet printer 100 are provided at both edges in the longer side direction of the container front surface 3*a*, which is one surface of the cartridge main body 3, that is, are provided at positions having high rigidity close to the cartridge main body 3. Therefore, even though a torsional load is applied to the ink cartridge 1, displacement or deformation in the shorter side direction (displacement or deformation in directions of arrows F and G shown in FIG. 5) at both ends in a longitudinal direction (a longer side direction) of the container front surface 3*a* can be suppressed within fitting accuracy of the positioning portions 13 and 14 and the positioning pins 11 of the cartridge holder 110. The displacement or deformation can be further suppressed by the ink delivery port 17, the pressurized air introduction portion 21, the data storage unit 25, and the erroneous insertion prevention unit 29 disposed between the two positioning portions 13 and 14.

Therefore, even though a torsional load is applied to the ink cartridge 1 in a state where the ink cartridge 1 is mounted on the cartridge holder 110, displacement or deformation of the cartridge main body 3 can be suppressed through firm fixing by the two positioning portions 13 and 14, and thus a stable connection state can be kept by an accurate positioning state.

In the ink cartridge 1 of this embodiment, the erroneous insertion prevention unit 29 is provided between the two positioning portions 13 and 14. Therefore, when the ribs 29*a*, 29*b*, 29*c*, . . . of the erroneous insertion prevention unit 29 are fitted into the erroneous insertion prevention mechanism 27 of the cartridge holder 110, since the erroneous insertion prevention unit 29 is disposed between the two positioning portions, positioning to the erroneous insertion prevention mechanism 27 is accurately performed. For this reason, when a suitable ink cartridge 1 is mounted, an inconsistency that the erroneous insertion prevention unit is shifted with respect to the erroneous insertion prevention mechanism 27 and comes into contact with the erroneous insertion prevention mechanism 27 before an original mounting position, and mounting is impossible does not occur. Then, the ink cartridge 1 suitable for the cartridge holder 110 is reliably mounted.

In the ink cartridge 1 of this embodiment, the second fitting hole, which is one positioning portion 14 of the two positioning portions 13 and 14, is formed in an elliptical sectional shape. Then, the positioning pin 11 that is fitted into the second fitting hole moves in a major axis direction of the ellipse, and thus an error in length in the longer side direction of the container front surface 3*a* of the cartridge main body 3 is allowed. Therefore, with the error in length, mounting capability to the cartridge holder 110 can be prevented from being damaged, and thus a work, such as replacement of the ink cartridge 1 to the cartridge holder 110, can be easily performed.

In the ink cartridge 1 of this embodiment, the first fitting hole, which is one positioning portion 13 of the two positioning portions 13 and 14, is formed in the circular sectional shape. The columnar positioning pin 11 of the cartridge holder 110 is closely fitted into the first fitting hole, such that the position is uniformly regulated over in all directions in the section. Accordingly, high positioning accuracy is shown. Therefore, positioning of the data storage unit 25 disposed close to the first fitting hole can be made with high accuracy, and there is no case where contact failures to the connection terminal 23 of the cartridge holder 110 is caused by degradation of positioning accuracy.

The two positioning portions 13 and 14 are not limited to the circular section shape and the elliptical sectional shape, but may have a rectangular sectional shape. Further, the two positioning portions 13 and 14 are not limited to the hole structure. For example, the positioning portions may be provided by forming concave portions that restrict the positioning pins 11 at the outer surface of the cartridge main body 3.

In the ink cartridge 1 of this embodiment, the connection mechanisms, such as the two positioning portions 13 and 14, the pressurized air introduction portion 21, the data storage unit 25, and the erroneous insertion prevention unit 29, which are disposed at one surface of the cartridge main body 3, are disposed toward one side of the shorter side direction (the cartridge thicknesswise direction) from the ink delivery port 17 of one surface of the cartridge main body 3. Therefore, the inside of the cartridge main body 3 on a side where the connection mechanisms are not disposed can be used as the ink containing chamber 7 or the pressure chamber. Therefore, the external shape of the ink cartridge 1 relative to the internal volume can be reduced in size. In addition, since the connection mechanisms provided in the cartridge holder 110 are disposed toward one side, the configuration of the cartridge holder 110 can be reduced in size in the thicknesswise direction, and thus the ink cartridge 1 and the cartridge holder 110 can be reduced in size.

In the ink cartridge 1 of this embodiment, the locking portion 26 that is provided at the container side surface 3*d* perpendicular to the container front surface 3*a* of the main body main portion 3*b* and regulates separation of the container main body 3 from the cartridge holder 110 by fitting of the locking piece 28 provided in the cartridge holder 110 is disposed on the substantially same plane as the two positioning portions 13 and 14. For this reason, when the container main body 3 is mounted on the cartridge holder 110, the locking portion 26 of the container main body 3 is accurately positioned with respect to the cartridge holder 110. Therefore, the locking piece 28 provided in the cartridge holder 110 can accurately anchor the locking portion 26 of the container main body 3. As a result, separation of the container main body 3 from the cartridge holder 110 can be reliably prevented.

Since a force applied from the locking piece 28 of the cartridge holder 110 to the locking portion 26 of the container main body 3 is applied within the substantially same plane as the two positioning portions 13 and 14, surface deflection of the container main body 3 with respect to the plane can be prevented. Therefore, deflection of the container main body 3 in a surface direction of the connection terminal, which causes degradation of contact of the connection terminal of the data storage unit 25 and the connection terminal 23 of the cartridge holder 110, can be reliably prevented. As a result, electrical connection of the connection terminal of the data storage unit 25 and the connection terminal 23 of the cartridge holder 110 can be improved.

The pressure chamber 5 is formed inside the butt structure of the main body main portion 3*b* and the cover portion 3*c* covering the opening portion of the main body main portion 3*b* by sealing the opening portion of the main body main portion 3*b* provided on a side opposite to the side, on which the two positioning portions 13 and 14, the pressurized air introduction portion 21, the data storage unit 25, and the erroneous insertion prevention unit 29 are disposed, by the film 30. For this reason, the pressure chamber 5 is formed inside the main body main portion 3*b* by loading the pouch body 8 containing the ink liquid from the opening portion of the main body main portion 3*b* to the main body main portion 3*b* having the two positioning portion 13 and 14, the pressurized air introduction portion 21, the data storage unit 25, and the erroneous insertion prevention unit 29, and then welding and sealing the peripheral portion of the opening portion of the main body main portion 3*b* by the film 30. After the pressure chamber 5 is formed by welding the film 30, the cover portion 3*c* is assembled to the main body main portion 3*b* from the above of the film 30, and thus the configuration of the ink cartridge 1 is completed. As such, loading of the pouch body 8 to the main body main portion 3*b* can be performed from the large opening portion not having the connection mechanisms, such as the positioning portions 13 and 14 and so on. Further, since welding of the film 30 is performed on the peripheral portion of the opening portion of the main body main portion 3*b*, the connection mechanisms do not obstruct a welding work, and assembling of the cover portion 3*c* is easily performed. Therefore, the ink cartridge 1 of this embodiment has good assembling workability.

The use of the liquid container according to the invention is not limited to the ink cartridge described in the above embodiment. For example, the liquid container of the invention is suitable for detachably mounting a liquid container on a container mounting portion and supplying a liquid to a liquid jetting head of a liquid jetting apparatus. Examples of the liquid jetting apparatus described herein include an ink jet recording apparatus having a liquid jetting head (a printing head), an apparatus having a color material jetting head used in manufacturing color filters of a liquid crystal display or the like, an apparatus having an electrode material (conductive paste) jetting head used in forming electrodes of an organic electroluminescent (EL) display or a surface emission display (FED), an apparatus having a bioorganic compound jetting head used in manufacturing a bio-chip, or an apparatus having a sample spraying head as a precision pipette.

What is claimed is:

1. A liquid container adapted to be mounted on a container mounting portion of an apparatus, comprising:

a pressure chamber configured to accommodate pressurized fluid;

a pressurized fluid introduction portion, adapted to be connected to a pressurized fluid supply path of the container mounting portion, and configured to introduce pressurized fluid therethrough from the apparatus to the pressure chamber;

a liquid containing chamber storing liquid therein, and a volume of which is reducible by pressure due to the pressurized fluid to be supplied to the pressure chamber;

a first positioning portion and a second positioning portion, adapted to receive positioning units provided at two places in the container mounting portion so as to position the liquid container relative to the container mounting portion;

a liquid delivery portion, adapted to be connected to a liquid supply path of the container mounting portion and configured to deliver the liquid stored in the liquid containing chamber therethrough to the apparatus;

a data storage unit, having a terminal adapted to be connected to a connection terminal of the container mounting portion; and a first surface, on which the first positioning portion, the second positioning portion and the liquid delivery portion are disposed, the first surface having a first longer side, a second longer side opposite to the first longer side, a first shorter side, and a second shorter side opposite to the first shorter side when viewed from a direction normal to the first surface; and wherein a position at which the first positioning portion is disposed, a position at which the second positioning portion is disposed, a position at which the pressurized fluid introduction portion is disposed, and a position at which the data storage unit is disposed are closer to the second longer side than a position at which the liquid delivery portion is disposed, when viewed from the direction normal to the first surface.

2. The liquid container according to claim 1, further comprising:

an erroneous insertion prevention unit, adapted to be fitted with an erroneous insertion prevention mechanism provided in the container mounting portion when the liquid container is suitable for the container mounting portion, and disposed at a position closer to the second longer side than the position at which the liquid delivery portion is disposed.

3. The liquid container according to claim 1 or 2, further comprising:

a second surface perpendicularly intersecting the first surface; and a locking portion, provided at the second surface adapted to be fitted with a locking piece provided in the container mounting portion for regulating separation of the liquid container from the container mounting portion, wherein the first positioning portion, the second positioning portion and the locking portion are disposed on the substantially same plane.

4. The liquid container according to claim 1, further comprising:

a main body main portion having an opening portion opened at a side closer to the first longer side; and a film sealing the opening portion and defining an inner space of the main body main portion, wherein the pressure chamber and the liquid containing chamber are provided in the inner space.

5. The liquid container according to claim 1, wherein the liquid delivery portion, the pressurized fluid introduction portion, and the data storage unit are disposed between the first positioning portion and the second positioning portion.

6. The liquid container according to claim 5, further comprising:

an erroneous insertion prevention unit, adapted to be fitted with an erroneous insertion prevention mechanism provided in the container mounting portion when the liquid container is suitable for the container mounting portion, wherein the erroneous insertion prevention unit is disposed closer to the second longer side.

7. The liquid container according to claim 5 or 6, wherein:

the positioning units a columnar first pin and a columnar second pin; and the first positioning portion is a hole having a circular sectional shape, and adapted to fit with the first pin, and the second positioning portion is a hole having an elliptical sectional shape and adapted to receive the second pin while allowing the second pin to move only in a direction parallel to the first longer side and the second longer side.

8. The liquid container according to claim 7, wherein the data storage unit is disposed closer to the first positioning portion than the second positioning portion.

9. A liquid container adapted to be mounted on a container mounting portion of an apparatus, comprising:

a first surface having a longer side, a first shorter side and a second shorter side opposite to the first shorter side;

a pressure chamber configured to accommodate pressurized fluid;

a pressurized fluid introduction portion, adapted to be connected to a pressurized fluid supply path of the container mounting portion, and configured to introduce pressurized fluid therethrough from the apparatus to the pressure chamber;

a liquid containing chamber storing liquid therein, and a volume of which is reducible by pressure due to the pressurized fluid to be supplied to the pressure chamber;

a first positioning portion and second positioning portion adapted to receive positioning units provided at two places in the container mounting portion so as to position the liquid container relative to the container mounting portion;

a liquid delivery portion adapted to be connected to a liquid supply path of the container mounting portion and configured to deliver the liquid stored in the liquid containing chamber therethrough to the apparatus; and a data storage unit having a terminal adapted to be connected to a connection terminal of the container mounting portion, wherein the first positioning portion is disposed in the vicinity of the first shorter side, and the second positioning portion is disposed in the vicinity of the second shorter side; and wherein the liquid delivery portion, the pressurized fluid introduction portion, and the data storage unit are disposed between the first positioning portion and the second positioning portion.

10. The liquid container according to claim 9, further comprising:

an erroneous insertion prevention unit, adapted to be fitted with an erroneous insertion prevention mechanism provided in the container mounting portion when the liquid container is suitable for the container mounting portion.

11. The liquid container according to claim 9 or 10, wherein the positioning units are a columnar first pin and a columnar second pin; and the first positioning portion is a hole having a circular sectional shape and adapted to fit with the first pin, and the second positioning portion is a hole having an elliptical sectional shape and adapted to receive the second pin while allowing the second pin to move only in a direction parallel to the first longer side.

12. The liquid container according to claim 11, wherein the data storage unit is disposed closer to the first positioning portion than the second positioning portion.

13. The liquid container according to claim 10, wherein:

the first positioning portion, the second positioning portion and the liquid delivery portion are disposed on the first surface;

the first surface has a second longer side opposite to the first longer side when viewed from a direction normal to the first surface; and a position at which the first positioning portion is disposed, a position at which the second positioning portion is disposed, a position at which the pressurized fluid introduction portion is disposed, and a position at which the data storage unit is disposed are disposed closer to the second longer side than a position at which the liquid delivery portion is disposed.

14. The liquid container according to claim 13, wherein the erroneous insertion prevention unit is disposed closer to the second longer side than the position at which the liquid delivery portion is disposed.

15. The liquid container according to claim 13 or 14, further comprising:

a main body portion having an opening portion opened at a side closer to the first longer side; and a film sealing the opening portion and defining an inner space of the main body main portion, wherein the pressure chamber and the liquid containing chamber are provided in the inner space.

* * * * *

UNITED STATES PATENT AND TRADEMARK OFFICE

CERTIFICATE OF CORRECTION

PATENT NO. : 7,651,208 B2
APPLICATION NO. : 11/465224
DATED : January 26, 2010
INVENTOR(S) : Hitoshi Matsumoto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 715 days.

Signed and Sealed this

Twenty-eighth Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,208 B2
APPLICATION NO. : 11/465224
DATED : January 26, 2010
INVENTOR(S) : Hitoshi Matsumoto and Hitotoshi Kimura It is certified that error appears in the above-identified patent and that said Letters Patent is hereby corrected as shown below:

Title Page:
Add the following additional inventor:

--(75) Inventors:
Hitotoshi Kimura, Nagano-ken (JP)--

Signed and Sealed this
Twenty-second Day of February, 2011

David J. Kappos

David J. Kappos
*Director of the United States Patent and Trademark Office*